US005641951A

United States Patent [19]

Cai et al.

[11] Patent Number: 5,641,951

[45] Date of Patent: Jun. 24, 1997

[54] ELEVATOR DOOR SAFETY DEVICE

[75] Inventors: Zhengwei Cai, Kawasaki; Masanori Nakamori, Yokohama, both of Japan

[73] Assignee: Otis Elevator Company, Farmington, Conn.

[21] Appl. No.: 521,777

[22] Filed: Aug. 31, 1995

[30] Foreign Application Priority Data

Feb. 23, 1995 [JP] Japan ..... 7-034816

[51] Int. Cl.[6] ..... B66B 13/26

[52] U.S. Cl. ..... 187/317; 187/392; 49/120

[58] Field of Search ..... 187/317, 316, 187/392; 49/120, 118, 117

[56] References Cited

U.S. PATENT DOCUMENTS

| | | | |
|---|---|---|---|
| Re. 33,668 | 8/1991 | Gray | 250/221 |
| 3,534,499 | 10/1970 | Chaffee | 49/25 |
| 3,691,556 | 9/1972 | Bloice | 343/5 PD |
| 3,796,208 | 3/1974 | Bloice | 128/2 R |
| 4,506,765 | 3/1985 | Payne | 187/29 R |
| 4,621,452 | 11/1986 | Deeg | 187/317 |
| 4,823,010 | 4/1989 | Kornbrekke | 250/341 |
| 4,858,156 | 8/1989 | Martin | 364/560 |
| 4,967,083 | 10/1990 | Kornbrekke | 250/341 |
| 5,001,557 | 3/1991 | Begle | 358/113 |
| 5,075,632 | 12/1991 | Payne | 328/5 |
| 5,142,152 | 8/1992 | Boiucaner | 250/341 |
| 5,149,921 | 9/1992 | Picado | 187/317 |
| 5,394,961 | 3/1995 | Biver | 187/317 |

FOREIGN PATENT DOCUMENTS

| | | | |
|---|---|---|---|
| 52-9248 | 1/1977 | Japan | 187/317 |
| 52-35048 | 3/1977 | Japan | 187/317 |
| 52-44936 | 4/1977 | Japan | 187/317 |
| 4-358686 | 12/1992 | Japan | 187/317 |

*Primary Examiner*—Robert Nappi
*Attorney, Agent, or Firm*—Joseph P. Abate

[57] ABSTRACT

An elevator door safety system includes hoistway side doors (2), (3) which open on both sides installed in the side of the hoistway in such a way that they can freely open and close, car side doors (5), (6) which open on both sides installed in the side of the car in such a way that they can freely open and close, a light-emitting element (10) and a light-receiving element (11) respectively provided on either door in the car side, and a pair of reflection members (12), (13) provided on either door in the hoistway side. The reflection members are arranged and dimensioned such that the light from the light-emitting element (10) is emitted toward one of the reflection members (12), which light is reflected from one of the reflection members (12) to the other reflection member (13), and from the other reflection member (13) toward the light-receiving element (11).

9 Claims, 5 Drawing Sheets

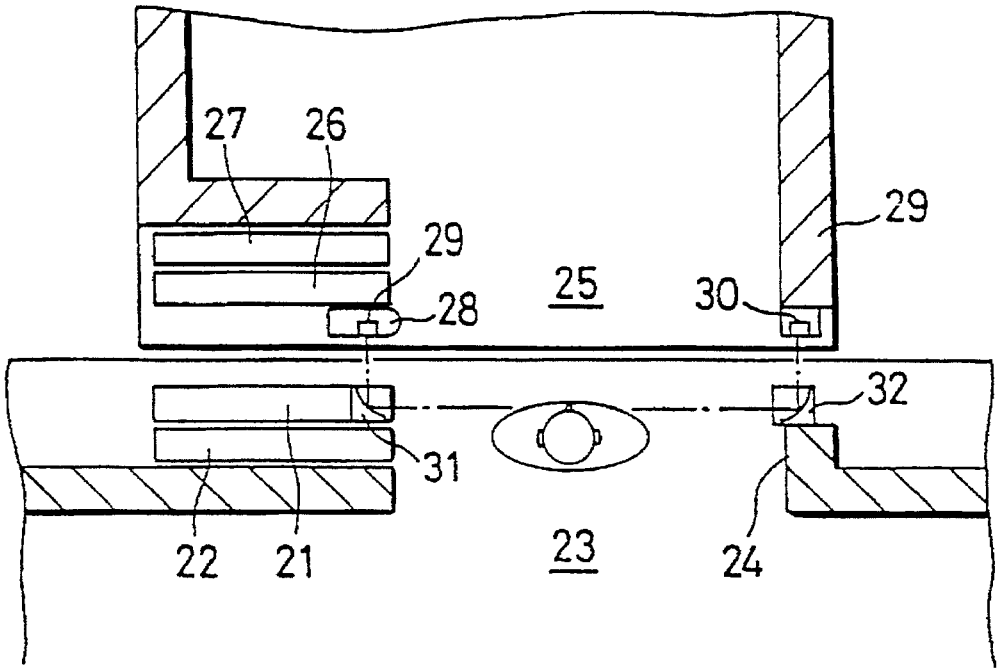
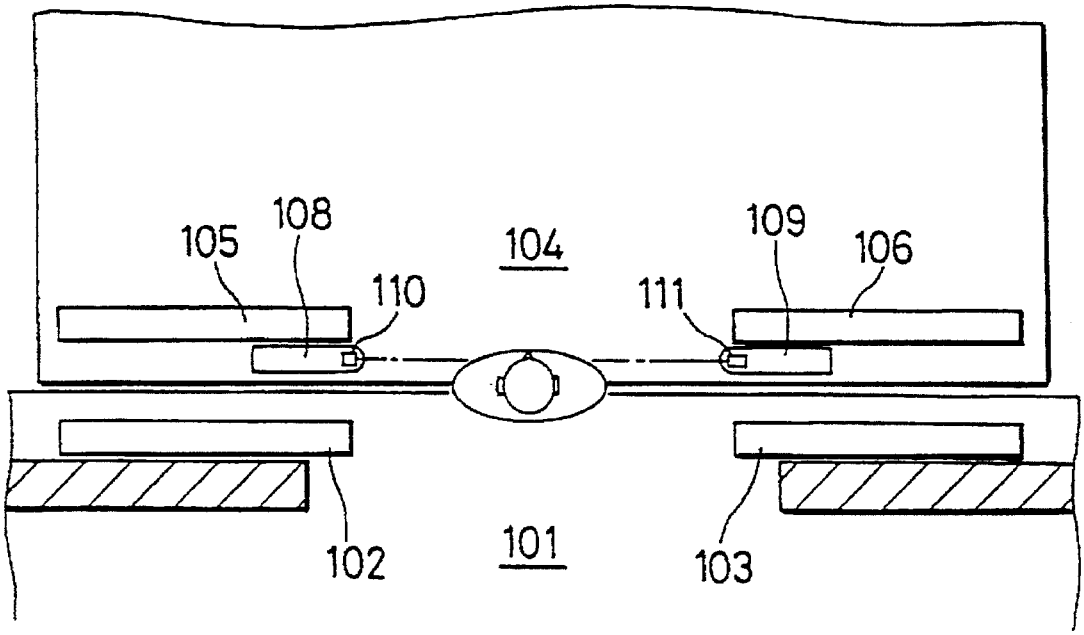
FIG.6

ELEVATOR DOOR SAFETY DEVICE

TECHNICAL FIELD

The present invention relates to safety devices and, particularly, to safety devices or arrangements for elevator doors.

BACKGROUND OF THE INVENTION

FIG. 6 is a diagram illustrating a conventional elevator door safety device. In this FIG. 6, (101) represents an entrance on a hoistway side. At this entrance (101), doors (102) and (103) which slide open on both sides are arranged. An entrance (104) on the car side faces entrance (101) on the hoistway side. At this entrance (104), doors (105) and (106) which slide open on both sides are arranged.

On car side doors (105) and (106), safety shoes (108) and (109) reverse the movement of doors (105), (106), (102), and (103) when they come in contact with passengers. A light-emitting element (110) and a light-receiving element (111) are installed as a photodetector on the safety shoes. When the photodetectors also detect the passengers, the movement of doors (102), (103), (105) and (106) reverses.

Because of cost and other considerations, safety shoes (108) and (109) and photodetectors (110) and (111) are installed on the door side instead of the hoistway side.

When the car reaches the hoistway landing, car side doors (105) and (106) and hoistway side doors (102) and (103) engage via engagement parts (not shown in the figure), and, when car side doors (105) and (106) open/close, hoistway side doors (102) and (103) also open/close in known interlocked fashion.

For this conventional elevator door safety device, the photodetectors (110) and (111) are arranged on the car side instead of the hoistway side. Therefore, when doors (102), (103), (105) and (106) are being closed, if some passengers (such as children or the elderly) enter the car slowly, hoistway side doors (102) and (103) may be in contact with the passengers before the passengers are detected by photodetectors (110) and (111). This may be dangerous.

DISCLOSURE OF THE INVENTION

It is a principal object of the present invention to provide a type of elevator door safety device in that even when passengers enter the car slowly as the doors are being closed, those passengers can still be detected.

In order to realize the aforementioned and other objects, an elevator door safety device (or system) according to the present invention includes a hoistway side door arranged to open on both sides and arranged on the hoistway side to freely open/close; a car side door arranged to open on both sides and arranged on the car side to freely open/close; a light-emitting element and a light-receiving element arranged on each side of the car side door, respectively; and a pair of reflection members arranged on each side of the hoistway side door, respectively; so that light emitted from the light-emitting element toward one of the reflection members is reflected from the one reflection member to the other reflection member, and then reflected from the other reflection member to the light-receiving element.

A further preferred embodiment of a door safety system according to the present invention includes, a hoistway side door arranged to open to one side, and arranged on the hoistway side to freely open/close, and having a fast side and a slow side, with the fast side in contact with the entrance; a car side door arranged to open to one side, and arranged on the car side to freely open/close, and having a fast side and a slow side, with the fast side in contact with the entrance; a light-emitting element and a light-receiving element arranged on the fast side of the car side door and the entrance in contact with it, respectively; and a pair of reflection members arranged on the fast side of the aforementioned hoistway side door and the entrance in contact with it, respectively; so that light emitted from the light-emitting element toward one of the reflection members is reflected from the reflection member to the other reflection member, and then reflected from the other reflection member to the light-receiving element.

Therefore, when the doors are being closed, if passengers enter the car slowly, the hoistway side door tends to come in contact with the passengers. However, because the light emitted from the light-emitting element is in the direction of the opening/closing of the hoistway side door, and it is now intercepted by the passenger, the passenger is detected. As soon as the passenger is detected by the photodetector, the movement of the door is reversed.

Further and still other objects of the present invention will become more readily apparent when the following detailed description is taken in conjunction with the accompanying drawing, in which:

BRIEF DESCRIPTION OF THE DRAWING

FIG. 5 is a plan view of the second embodiment.

FIG. 6 is a plan view of a conventional elevator door safety device.

BEST MODE FOR CARRYING OUT THE INVENTION

Figure 1:
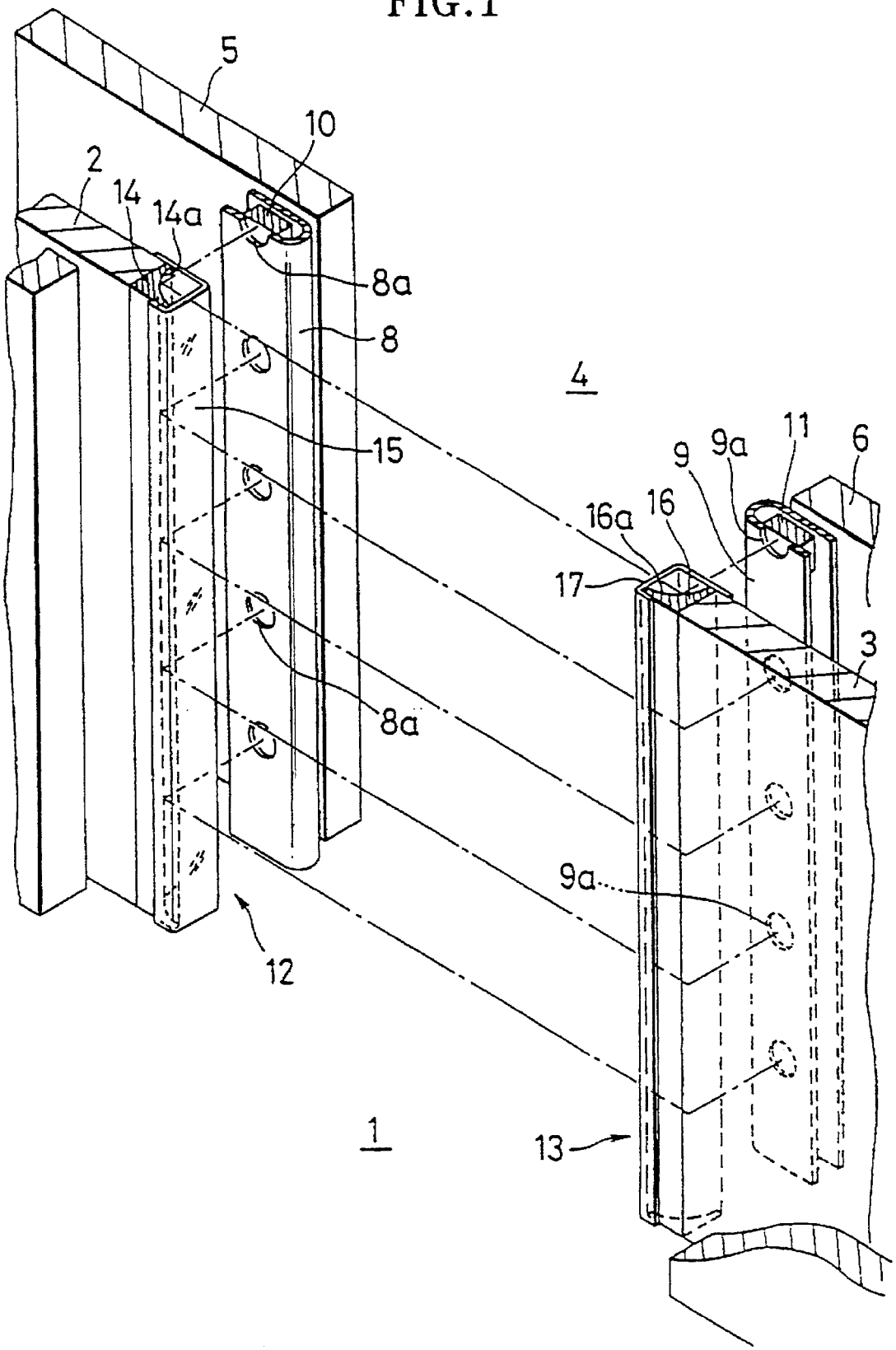
FIG. 1 is an oblique view illustrating a first embodiment of the elevator door safety device of the present invention.
Figure 2:
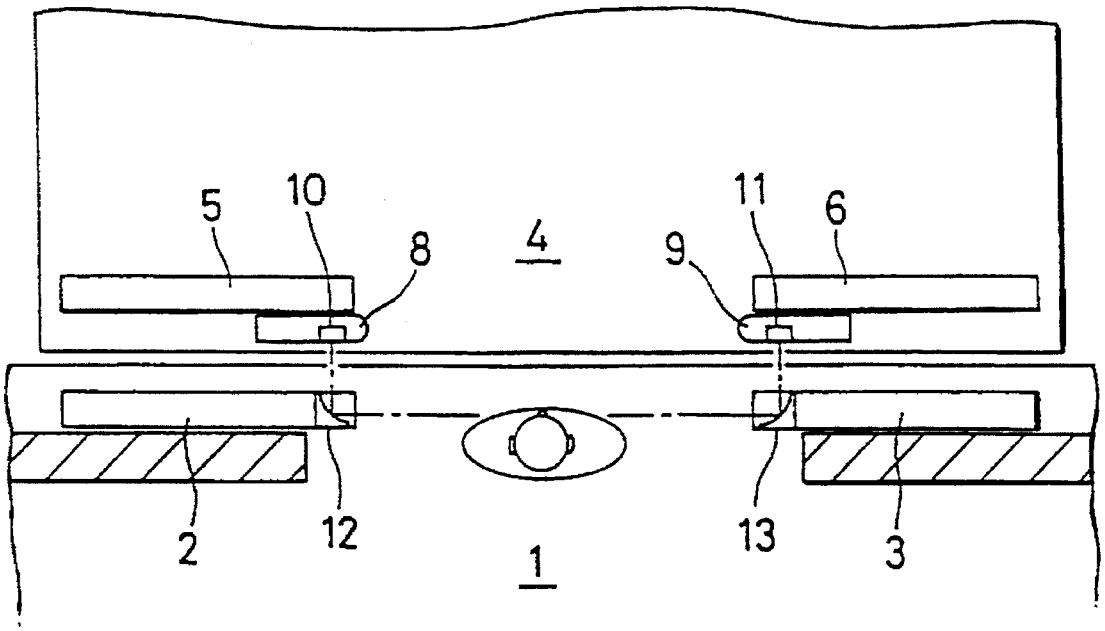
FIG. 2 is a plan view of the first embodiment.
Figure 3:
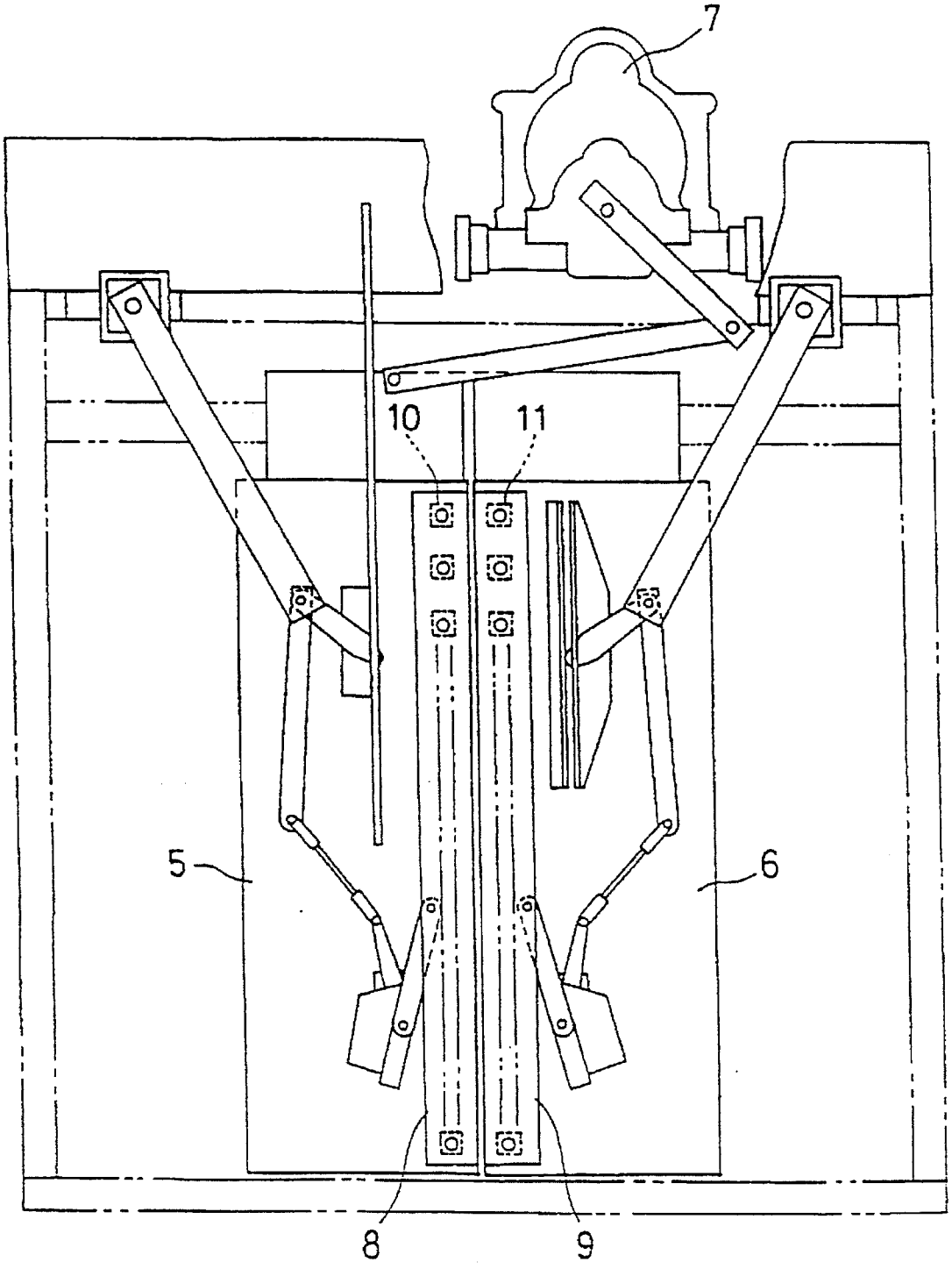
FIG. 3 is a front view of the car side doors of FIG. 1.

The present invention will be explained in more detail with reference to FIGS. 1–5. FIGS. 1–3 are diagrams illustrating a first embodiment of the elevator door safety device (or system) of this invention.

In FIGS. 1 and 2, (1) represents the hoistway side entrance. At this entrance (1), hoistway doors (2) and (3) which are open on both sides are arranged to freely slide open/close. A car side entrance (4) is arranged facing the hoistway side entrance (1). At this entrance (4), car side doors (5) and (6) which open on both sides are arranged to freely slide open/close.

As shown in FIG. 3, car side doors (5) and (6) open/close by means of door operator (7) arranged above the car. In this case, hoistway side doors (2) and (3) also open/close in interlocked fashion. Safety shoes (8) and (9) are arranged on the edges of doors (5) and (6). When the bodies of passengers are in contact with the safety shoes (8) and (9) during normal elevator operation, the passengers are detected.

Also, a light-emitting element (10) and a light-receiving element (11) for detecting the passengers during normal elevator operation are installed on safety shoes (8) and (9). Preferably, multiple (such as a plurality of) light-emitting elements (10) and light-receiving elements (11) are arranged in safety shoes (8) and (9) having nearly U-shaped cross sections. Through-holes (**8*a*), (9*a*) are formed at sites where light-emitting elements (10**) and light-receiving elements

(11) are located. Light-emitting element (10) and light-receiving element (11) face hoistway side doors (2) and (3), respectively. Each light-emitting element (10) emits light through a respective through-hole (8*a*), while each light-receiving element (11) receives the emitted light through a respective through-hole (9*a*).

Reflection members (12) and (13) are installed on the edges of hoistway side doors (2) and (3). The reflection member (12) is made of (or includes) a body (14) (e.g., acrylic, other plastic or even metal) having a reflective surface (14*a*) (e.g., the body being bonded to an aluminum foil) in approximately an arc shape, and a protective portion (15) made of a transparent material such as an acrylic resin for protecting the body (14). Also, reflection member (13) is made of (or includes) a body (16) having reflective surface (16*a*), and protective portion (17).

Reflective surface (14*a*) of reflection member (12) is appropriately arranged and dimensioned to ensure that the light emitted from light-emitting element (10) is reflected towards reflection member (13). Reflective surface (16*a*) of reflection member (13) is appropriately arranged and dimensioned to ensure that the light is reflected to light-receiving element (11). Consequently, the light emitted from light-emitting element (10) travels in the opening/closing direction of hoistway side doors (2) and (3) by means of reflection members (12) and (13).

When the car arrives at a hoistway landing, car side doors (5) and (6) and hoistway side doors (2) and (3) engage. As car side doors (5) and (6) open/close by means of door operator (7), hoistway side doors (2) and (3) open/close in interlocked fashion. If a passenger slowly enters the car while doors (2), (3), (5), and (6) are closing, hoistway side doors (2) and (3) tend to come in contact with the passenger.

However, because the light emitted from light-emitting element (10) travels in the opening/closing direction of hoistway side doors (2) and (3), this light is intercepted by the passenger, and the passenger is detected. Because the passenger is detected by photodetectors (10) and (11), doors (2), (3), (5) and (6) reverse their direction. Consequently, the doors (2), (3), (5) and (6) do not make contact with the aforementioned passenger.

A second embodiment will now be explained with reference to FIGS. 4 and 5.

Figure 4:
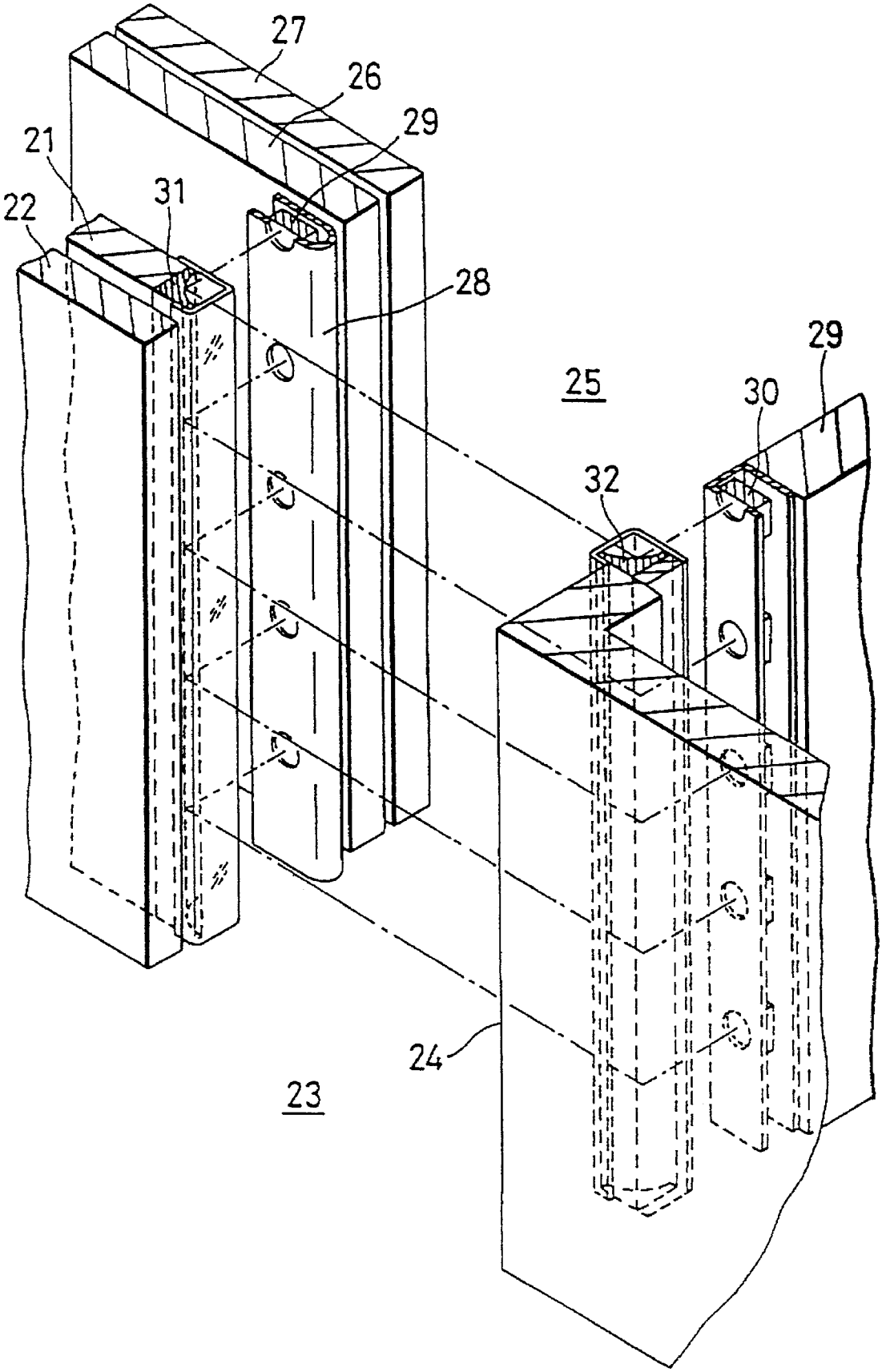
FIG. 4 is an oblique view of a second embodiment according to the present invention.

In this FIG. 4, (21) and (22) represent doors which open to one side arranged at an entrance (23) of the hoistway. The door (21) is the fast side door, while the door (22) is the slow side door. The fast side door (21) is in contact with side jam (24) of entrance (23). Also, doors (26) and (27) which open to one side are also arranged at an entrance (25) on the car side. Fast side door (26) is in contact with a return panel (33) of entrance (25).

Light-emitting element (29) is installed on safety shoe (28) on the tip side of fast side door (26). Light-receiving element (30) is installed on return panel (33). Then, one reflection member (31) is installed on fast side door (21), while the other reflection member (32) is installed on side jam (24).

As explained above, according to this invention, the light emitted from the light-emitting element travels in the direction of opening/closing of the hoistway side doors by means of a pair of reflection members. As a result, when the light is intercepted by the passengers entering the car, the passengers are detected by the photodetectors. Consequently, the doors do not make contact with the passengers as they are being closed, and the safety of the passengers can be enhanced.

Although the invention has been shown and described with respect to a best mode embodiment thereof, it should be understood by those skilled in the art that various other changes, omissions and additions in the form and detail thereof may be made therein without departing from the spirit and scope of the invention.

What is claimed is:

1. An elevator door safety device, comprising:

bi-parting hoistway doors arranged on a hoistway such that the bi-parting hoistway doors can freely open and close, bi-parting car doors arranged on a car such that the bi-parting car doors can freely open and close, a light-emitting element provided on one of the bi-parting car doors, and a light-receiving element provided on the other of the bi-parting car doors and a pair of reflection members provided on the bi-parting hoistway doors, the light-emitting element, the light-receiving element and the reflection members being arranged and dimensioned such that light from the light-emitting element is emitted toward one of the reflection members, which light is reflected from the one reflection member to the other reflection member, and from the other reflection member toward the light-receiving element.

2. A device as claimed in claim 1, wherein the one reflection member is arranged and dimensioned to reflect the light from the light-emitting element in a direction of one of the hoistway side doors.

3. A device as claimed in claim 1, wherein the one reflection member comprises a reflective surface having a curved shape.

4. A device as claimed in claim 1, wherein the curved shape is nearly U-shaped.

5. A device as claimed in claim 4, wherein the other reflection member comprise a reflective surface having an arcuate shape.

6. A device as claimed in claim 5, wherein the one reflective member further comprises a protective portion covering the reflective surface, the protective portion including a transparent material.

7. A device as claimed in claim 6, wherein the transparent material is a transparent plastic.

8. A device as claimed in claim 3, wherein the reflective surface comprises a metallic material.

9. A device as claimed in claim 8, wherein the metallic material is aluminum.

* * * * *